US011344461B2

(12) United States Patent
Rowe et al.

(10) Patent No.: US 11,344,461 B2
(45) Date of Patent: May 31, 2022

(54) SUPPORT CUSHION LINERS COMPRISING ARTIFICIAL MUSCLES

(71) Applicant: Toyota Motor Engineering & Manufacturing North America, Inc., Plano, TX (US)

(72) Inventors: Michael P. Rowe, Pinckney, MI (US); Ryohei Tsuruta, Ann Arbor, MI (US); Danil Prokhorov, Canton, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 0 days.

(21) Appl. No.: 16/931,578

(22) Filed: Jul. 17, 2020

(65) Prior Publication Data

US 2022/0015971 A1 Jan. 20, 2022

(51) Int. Cl.
*A61G 7/057* (2006.01)
*A47C 27/10* (2006.01)

(52) U.S. Cl.
CPC ..... *A61G 7/05776* (2013.01); *A47C 27/10* (2013.01)

(58) Field of Classification Search
CPC ..... A61G 7/05776; A61G 13/009; A61G 15/007; A61G 5/1045; A61G 13/127;
(Continued)

(56) References Cited

U.S. PATENT DOCUMENTS 4,347,633 A * 9/1982 Gammons ..... A61G 7/05784 5/713
7,493,160 B2 * 2/2009 Weber ..... A61M 25/00 607/3

(Continued)

FOREIGN PATENT DOCUMENTS

CN 109744785 A 5/2019
CN 209812321 U 12/2019

(Continued)

OTHER PUBLICATIONS

Shane Mitchell, et al., "An Easy-To-Implement Toolkit To Create Versatile And High-Performance HASEL Actuators For Untethered Soft Robots," Journal Article, Advanced Science 6(14):1900178, Jun. 2019, URL: https://www.researchgate.net/figure/Generalized-principle-of-zipping-mode-actuation-in-HASEL-actuators-As-voltage-is_fig1_333725822, 15 pages.

(Continued)

*Primary Examiner* — David R Hare
*Assistant Examiner* — George Sun
(74) *Attorney, Agent, or Firm* — Dinsmore & Shohl LLP

(57) ABSTRACT

A support cushion liner includes a liner body having a cavity disposed between an outer layer and an inner layer and a plurality of artificial muscles disposed in the cavity of the liner body. Each of the plurality of artificial muscles include a housing having an electrode region and an expandable fluid region, a dielectric fluid housed within the housing, and an electrode pair positioned in the electrode region of the housing. The electrode pair includes a first electrode fixed to a first surface of the housing and a second electrode fixed to a second surface of the housing. The electrode pair is actuatable between a non-actuated state and an actuated state such that actuation from the non-actuated state to the actuated state directs the dielectric fluid into the expandable fluid region, expanding the expandable fluid region thereby applying pressure to the outer layer of the liner body.

20 Claims, 10 Drawing Sheets

(58) Field of Classification Search
CPC .... A47C 27/10; A47C 27/085; A61H 9/0021; A61H 2203/0456; A61H 2203/0468; A61F 2/08
See application file for complete search history.

(56) References Cited

U.S. PATENT DOCUMENTS

| | | | | |
|---|---|---|---|---|
| 7,679,261 | B2 * | 3/2010 | Chappaz | H02N 1/006 310/309 |
| 8,127,386 | B2 * | 3/2012 | Kajiwara | A61G 7/05776 5/713 |
| 8,922,225 | B2 * | 12/2014 | Chiou | A61B 5/6892 324/649 |
| 10,233,910 | B2 * | 3/2019 | Mazzeo | B25J 9/142 |
| 2001/0034908 | A1 * | 11/2001 | Daly | A61G 7/05776 5/713 |
| 2006/0010607 | A1 * | 1/2006 | Schneider | F16K 31/002 5/713 |
| 2008/0201858 | A1 * | 8/2008 | Caminade | F16K 31/0606 5/713 |
| 2009/0106905 | A1 | 4/2009 | Ochi et al. | |
| 2010/0253183 | A1 * | 10/2010 | Ando | G01L 1/16 310/365 |
| 2012/0317720 | A1 * | 12/2012 | Chiang | A61G 7/02 5/713 |
| 2014/0053311 | A1 * | 2/2014 | Nordstrom | B32B 3/08 2/69 |
| 2014/0090489 | A1 * | 4/2014 | Taylor | A61B 5/6892 73/862.626 |
| 2014/0101862 | A1 * | 4/2014 | Misaki | A61G 7/05769 5/710 |
| 2014/0373594 | A1 * | 12/2014 | Remez | G01L 1/146 73/1.08 |
| 2016/0317370 | A1 * | 11/2016 | Evans | G05B 15/02 |
| 2018/0027988 | A1 * | 2/2018 | Poodeh | A47G 9/1027 |
| 2021/0003149 | A1 * | 1/2021 | Keplinger | F15B 15/10 |

FOREIGN PATENT DOCUMENTS

| | | | |
|---|---|---|---|
| CN | 210354022 | U | 4/2020 |
| JP | 2007097292 | A | 4/2007 |
| WO | 2019002860 | A1 | 1/2019 |
| WO | 2019173227 | A1 | 9/2019 |
| WO | 2019232621 | A1 | 12/2019 |

OTHER PUBLICATIONS

E. Acome, et al., "Hydraulically Amplified Self-Healing Electrostatic Actuators With Muscle-Like Performance," Science Journal, Jan. 5, 2018: vol. 359, Issue 6371, pp. 61-651, Department of Mechanical Engineering & Materials Science and Engineering Program, University of Colorado, Boulder, CO 80309, USA.

* cited by examiner

SUPPORT CUSHION LINERS COMPRISING ARTIFICIAL MUSCLES

TECHNICAL FIELD

The present specification generally relates support cushion liners such as bed liners, and in particular, to support cushion liners that include artificial muscles for providing selective pressure to a user.

BACKGROUND

Adjustment of pressure distribution to a person with confined mobility, such as a person limited to a bed or wheelchair, may limit the formation of bedsores and other ailments while also relieving physical fatigue. Currently, adjustment of pressure distribution to a person in a bed or a chair may be performed by pneumatically-driven devices or electric motor driven devices. However, current technology is complicated, bulky and limited in its ability to provide selective and targeted relief to a person. Indeed, in the case of a bed-ridden patient, a nurse is often required to physically move a patient regularly.

Accordingly, a need exists for improved devices for providing adjustable pressure distribution to a person, such as a person with limited mobility.

SUMMARY

In one embodiment, a support cushion liner includes a liner body having a cavity disposed between an outer layer and an inner layer and a plurality of artificial muscles disposed in the cavity of the liner body. Each of the plurality of artificial muscles include a housing having an electrode region and an expandable fluid region, a dielectric fluid housed within the housing, and an electrode pair positioned in the electrode region of the housing. The electrode pair includes a first electrode fixed to a first surface of the housing and a second electrode fixed to a second surface of the housing. The electrode pair is actuatable between a non-actuated state and an actuated state such that actuation from the non-actuated state to the actuated state directs the dielectric fluid into the expandable fluid region, expanding the expandable fluid region thereby applying pressure to the outer layer of the liner body.

In another embodiment, a support cushion liner includes a liner body having a cavity disposed between an outer layer and an inner layer, a plurality of pressure sensors disposed in the cavity of the liner body, and a plurality of artificial muscles disposed in the cavity of the liner body. Each artificial muscle of the plurality of artificial muscles include a housing comprising an electrode region and an expandable fluid region, a dielectric fluid housed within the housing, and an electrode pair positioned in the electrode region of the housing. The electrode pair includes a first electrode fixed to a first surface of the housing and a second electrode fixed to a second surface of the housing. The electrode pair is actuatable between a non-actuated state and an actuated state such that actuation from the non-actuated state to the actuated state directs the dielectric fluid into the expandable fluid region. Moreover, each of the plurality of artificial muscles are independently actuatable to apply selective pressure to the outer layer of the liner body in response to one or more pressure measurements by the plurality of pressure sensors.

In yet another embodiment, a method for actuating a support cushion liner includes generating a voltage using a power supply electrically coupled to an electrode pair of an artificial muscle, the artificial muscle disposed in a cavity between an inner layer and an outer layer of a liner body. The artificial muscle includes a housing having an electrode region and an expandable fluid region, the electrode pair is positioned in the electrode region of the housing, the electrode pair includes a first electrode fixed to a first surface of the housing and a second electrode fixed to a second surface of the housing, and a dielectric fluid is housed within the housing. The method further includes applying the voltage to the electrode pair of the artificial muscle, thereby actuating the electrode pair from a non-actuated state to an actuated state such that the dielectric fluid is directed into the expandable fluid region of the housing and expands the expandable fluid region, thereby applying pressure to the outer layer of the liner body.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
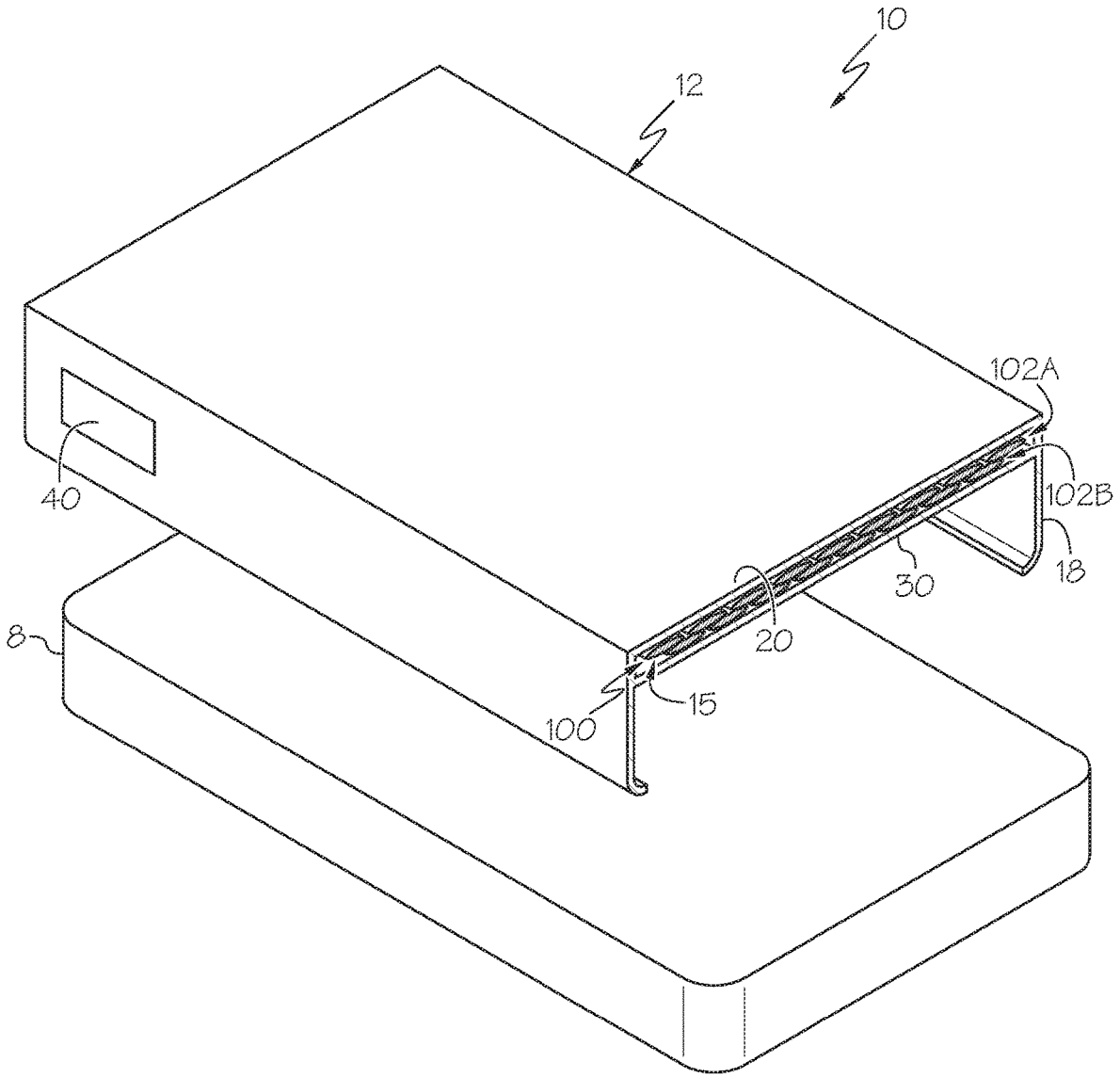
FIG. 1 schematically depicts a support cushion and a support cushion liner having a plurality of artificial muscles, according to one or more embodiments shown and described herein.

Embodiments described herein are directed to support cushion liner that includes artificial muscles configured to apply a selective pressure to a user such as a bed ridden or wheelchair bound patient. The support cushion liner described herein includes a liner body having an inner layer, an outer layer, and a plurality of artificial muscles disposed in a cavity between the inner layer and the outer layer. The plurality of artificial muscles disposed in the cavity of the liner body are actuatable to selectively raise and lower a region of the artificial muscles to provide a selective, on demand inflated expandable fluid region. In particular, the plurality of artificial muscles each include an electrode pair that may be drawn together by application of a voltage, thereby pushing dielectric fluid into the expandable fluid region, which applies localized pressure to the outer layer of the liner body. Thus, actuation of the plurality of artificial muscles of the support cushion liner may apply selective and customizable pressure to a user sitting or lying on the support cushion liner. Indeed, the support cushion liner may be used to adjust the pressure distribution applied to a user, such as a user with limited mobility (e.g. bedridden or wheelchair bound). The pressure distribution adjustment may delay, if not prevent the formation of bed sores on the user. Moreover, the support cushion liner may be used on a vehicle seat or airline seat to improve user comfort and reduce physical fatigue of users in long travel situations. Various embodiments of the support cushion liner and the operation of the support cushion liner are described in more detail herein. Whenever possible, the same reference numerals will be used throughout the drawings to refer to the same or like parts.

Figure 2:
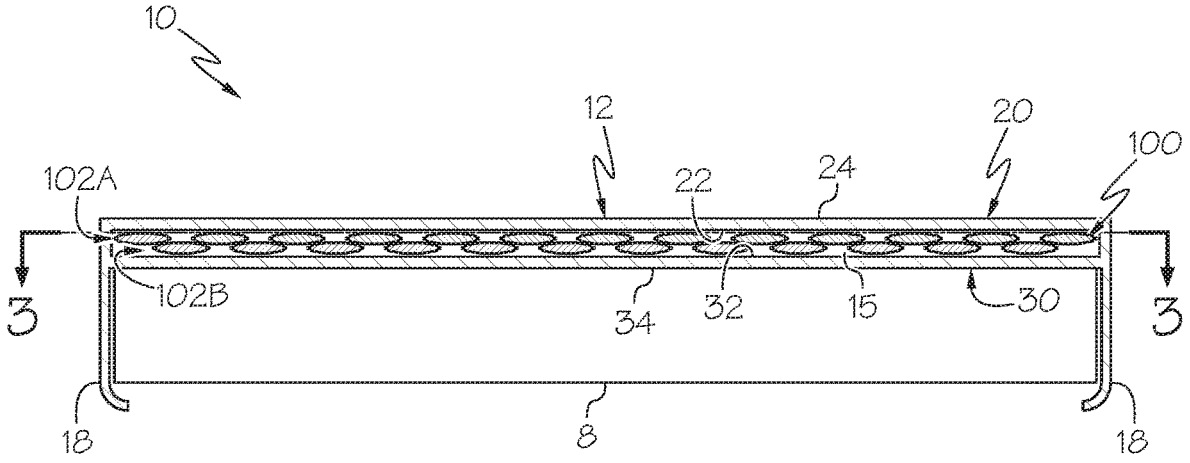
FIG. 2 schematically depicts a cross section of a support cushion and a support cushion liner having a plurality of artificial muscles disposed therein, according to one or more embodiments shown and described herein.

Referring now to FIGS. 1 and 2, a support cushion liner 10 is schematically depicted. The support cushion liner 10 includes a liner body 12 which may be positioned on a support cushion 8, such as a mattress, a chair seat, or a chair back. For example, the liner body 12 may comprise a mattress liner (e.g., a mattress pad) for positioning over a mattress or a seat liner for positioning over a seat or back of a chair, such as a wheelchair, or other seating device. In FIGS. 1 and 2, the liner body 12 is depicted as a mattress liner, but it should be understood that the liner body 12 may be a liner or covering device for any bed, seat or other personal support device. As depicted in FIGS. 1 and 2, the liner body 12 comprises an outer layer 20, an inner layer 30, a cavity 15 disposed between the outer layer 20 and the inner layer 30, and one or more side sections 18 for coupling the liner body 12 to the support cushion 8. The support cushion liner 10 further comprises a plurality of artificial muscles 100 disposed in the cavity 15. In operation, each of the plurality of artificial muscles 100 are actuatable to expand and apply a pressure to the outer layer 20 of the liner body 12. When a user 5 sits or lays on the liner body 12, this pressure to the outer layer 20 causes the outer layer 20 to apply a selective pressure to the user 5. Furthermore, actuation of each of the plurality of artificial muscles 100 may be controlled by an actuation system 400 (FIG. 12), which may include components housed in an onboard control unit 40 coupled to the liner body 12.

Referring still to FIGS. 1 and 2, the inner layer 30 comprises an inner surface 32 facing the cavity 15 and an outer surface 34 opposite the inner surface 32. The inner surface 32 may contact at least some of the plurality of artificial muscles 100 disposed in the cavity 15. When the liner body 12 is coupled to the support cushion, the outer surface 34 faces and may contact the support cushion 8. The outer layer 20 comprises an inner surface 22 facing the cavity 15 and an outer surface 24 facing outward from the liner body 12 and may contact a user 5 that is sitting or lying on the liner body 12. The inner surface 22 of the outer layer 20 may contact at least one some of the plurality of artificial muscles 100 disposed in the cavity 15. At least the outer surface 24 of the outer layer 20 comprises a nonabsorbent material, such as nylon, polyester, or the like. In some embodiments, the entire outer layer 20 and even the entire liner body 12 may comprise a non-absorbent material. Using a non-absorbent material facilitates ease of cleaning, allowing for repeated use by one or multiple different users 5.

Referring now to FIGS. 1 and 2, the plurality of artificial muscles 100 each include an electrode pair 104 disposed in a housing 110 together with a dielectric fluid 198 (FIGS. 6-11). The electrode pair 104 is disposed in an electrode region 194 of the housing 110, adjacent an expandable fluid region 196. In operation, voltage may be applied to the electrode pair 104, drawing the electrode pair 104 together, which directs dielectric fluid into the expandable fluid region 196, expanding the expandable fluid region 196. In operation, the support cushion liner 10 is operable to apply selective pressure to the user 5 by actuation of one or more of the plurality of artificial muscles 100. To actuate the support cushion liner 10, voltage may be selectively applied to the one or more artificial muscles 101, expanding the expandable fluid regions 196 of the actuated artificial muscles 101. In some embodiments, each of the plurality of artificial muscles 100 are independently actuatable to apply selective pressure to the outer layer 20 of the liner body 12 which may apply pressure to the user 5 when the user is sitting or lying on the liner body 12.

Figure 3:
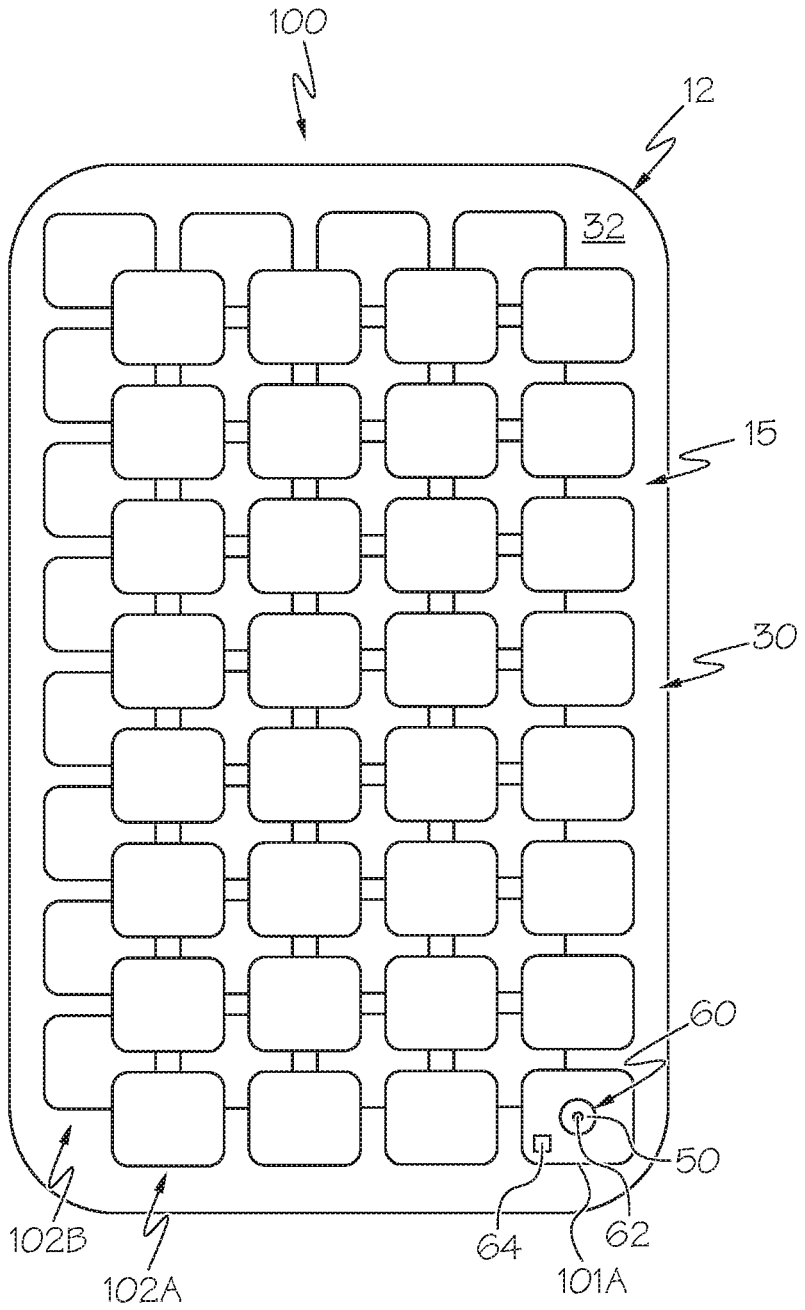
FIG. 3 schematically depicts a cross section of the support cushion liner along line 3-3 of FIG. 2, according to one or more embodiments shown and described herein.

Referring also to FIG. 3, which depicts a cross section of the support cushion liner 10 along line 3-3 of FIG. 2, the plurality of artificial muscles 100 may be arranged in a single layer between the inner layer 30 and the outer layer 20 or arranged in two or more layers between the inner layer 30 and the outer layer 20, as depicted in FIGS. 1-3. For example, in FIGS. 1-3, the plurality of artificial muscles 100 comprise a first layer of artificial muscles 102A and a second layer of artificial muscles 102B. The first layer of artificial muscles 102A are disposed nearer the outer layer 20 than the inner layer 30 of the liner body 12 and the second layer of artificial muscles 102 are disposed nearer the inner layer 30 of the liner body 12 than the outer layer 20 of the liner body 12. The first layer of artificial muscles 102A includes a first artificial muscle 101A having a pressure sensor 62, a temperature sensor 64, and a temperature altering device 70 coupled to the first artificial muscles 101A, as described in more detail below. Two layers of artificial muscles 102A, 102B are depicted in FIG. 1-3, however, it should be understood that any number of layers of artificial muscles are contemplated.

Moreover, in embodiments in which the plurality of artificial muscles 100 are arranged in multiple layers, individual artificial muscles 101 may be disposed on top of one another in an offset overlapping arrangement to form a closed packed multi-layer sheet of artificial muscles 101. This offset overlapping arrangement is such that the expandable fluid regions 196 of individual artificial muscles 101 in the first sheet of artificial muscles 102A are offset from expandable fluid regions 196 of individual artificial muscles 101 in the second sheet of artificial muscles 102B while at least some of the electrode regions 194 of the individual artificial muscles 101 of the first sheet of artificial muscles 102A overlap the electrode regions 194 of the individual artificial muscles 101 in the second sheet of artificial muscles 102B. In embodiments with three or more layers of artificial muscles 101, it should be understood that adjacent layers of artificial muscles have the offset overlapping arrangement of the first and second layers of artificial muscles 102A, 102B.

Figure 4A:
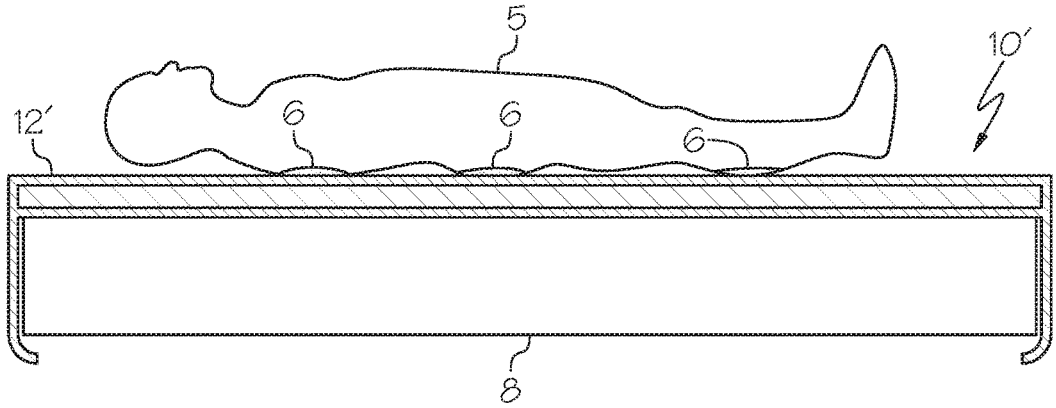
FIG. 4A schematically depicts a non-actuatable support cushion liner and a user positioned on the non-actuatable support cushion liner, according to one or more embodiments shown and described herein.
Figure 4B:
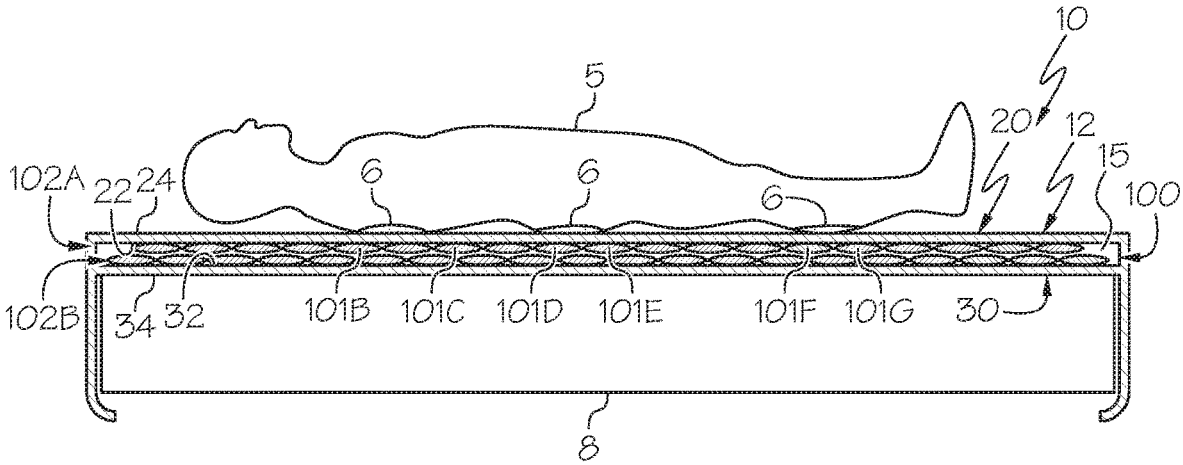
FIG. 4B schematically depicts the support cushion liner of FIGS. 1-3 in a non-actuated state and a user positioned on the support cushion liner, according to one or more embodiments shown and described herein.
Figure 4C:
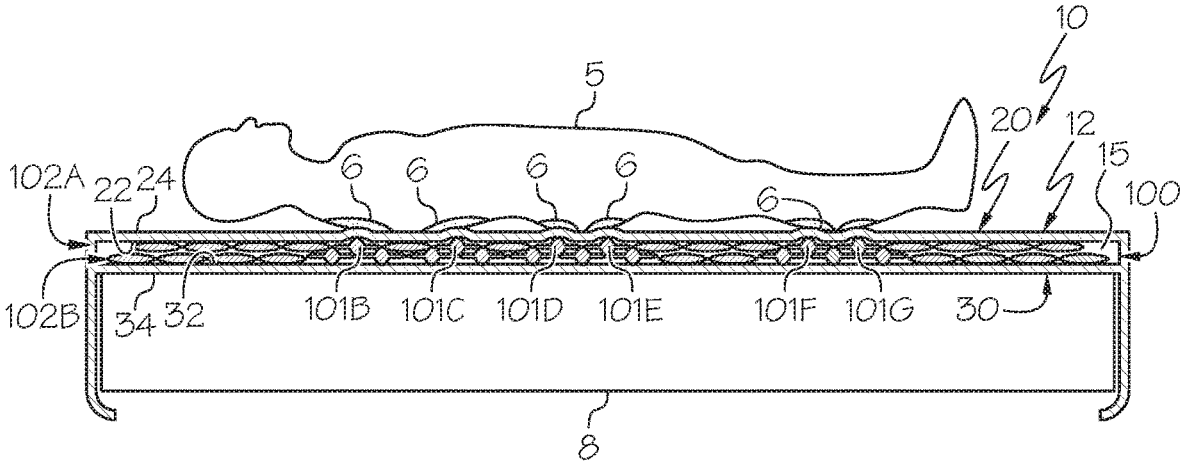
FIG. 4C schematically depicts the support cushion liner of FIGS. 1-3 in an actuated state and a user positioned on the support cushion liner, according to one or more embodiments shown and described herein.

Referring now to FIG. 4A-4C, the support cushion liner 10 (FIGS. 4B and 4C) and a non-actuatable support cushion liner 10' without artificial muscles 100 (FIG. 4A) are each shown with a user 5 lying thereon. As shown in FIGS. 4A-4C, when the user 5 lies on each support cushion liner 10, 10', pressure points 6 are present between the liner body 12, 12' and the user 5. Over time, these pressure points 6 may cause bedsores to develop on the user 5. In the non-actuatable support cushion liner 10' of FIG. 4A, these pressure points 6 do not change without moving the user 5. In contrast, the support cushion liner 10 of FIGS. 4B and 4C include the plurality of artificial muscles 100, which may be selectively actuated to alter the location of the pressure points 6 on the user 5. In particular, FIG. 4B shows the support cushion liner 10 in a non-actuated state (i.e., a state in which none of the plurality of artificial muscles 100 are actuated) and FIG. 4C shows the support cushion liner 10 in an actuated state (i.e. a state in which at least one or the plurality of artificial muscles 100 are actuated). In operation, each individual artificial muscle 101 of the plurality of artificial muscles 100 may be independently actuated to provide selective pressure to the user 5.

Referring now to FIGS. 4B and 4C, a second artificial muscle 101B and a third artificial muscle 101C are each part of the first array of artificial muscles 102A and are adjacently disposed to a pressure point 6 between the user 5 and the outer layer 30 of the liner body 12. A fourth artificial muscles 101D and a fifth artificial muscle 101E are each part of the first array of artificial muscles 102A and are adjacently disposed to another pressure point 6 between the user 5 and the outer layer 30 of the liner body 12. Similarly, a sixth artificial muscle 101F and a seventh artificial muscle 101G are each part of the first array of artificial muscles 102A and are adjacently disposed to yet another pressure point 6 between the user 5 and the outer layer 30 of the liner body 12. As shown in FIGS. 4B and 4C, actuating the second though the seventh artificial muscles 101B-101G adjusts the position of each of the pressure points 6 between the user 5 and the liner body 12. Moreover, actuating the artificial muscles 101 of the second layer of artificial muscles 102B that contact the actuated artificial muscles of the first layer of artificial muscles 102A (e.g., the second though the seventh artificial muscles 101B-101G) may increase the stroke and the force applied by the second though the seventh artificial muscles 101B-101G to the outer layer 30 of the liner body 12. In operation, selective actuation of the artificial muscles 101 continuously or sporadically alter the pressure points 6 between the outer layer 20 and the user 5 by selective actuation of the plurality of artificial muscles 100.

Figure 5:
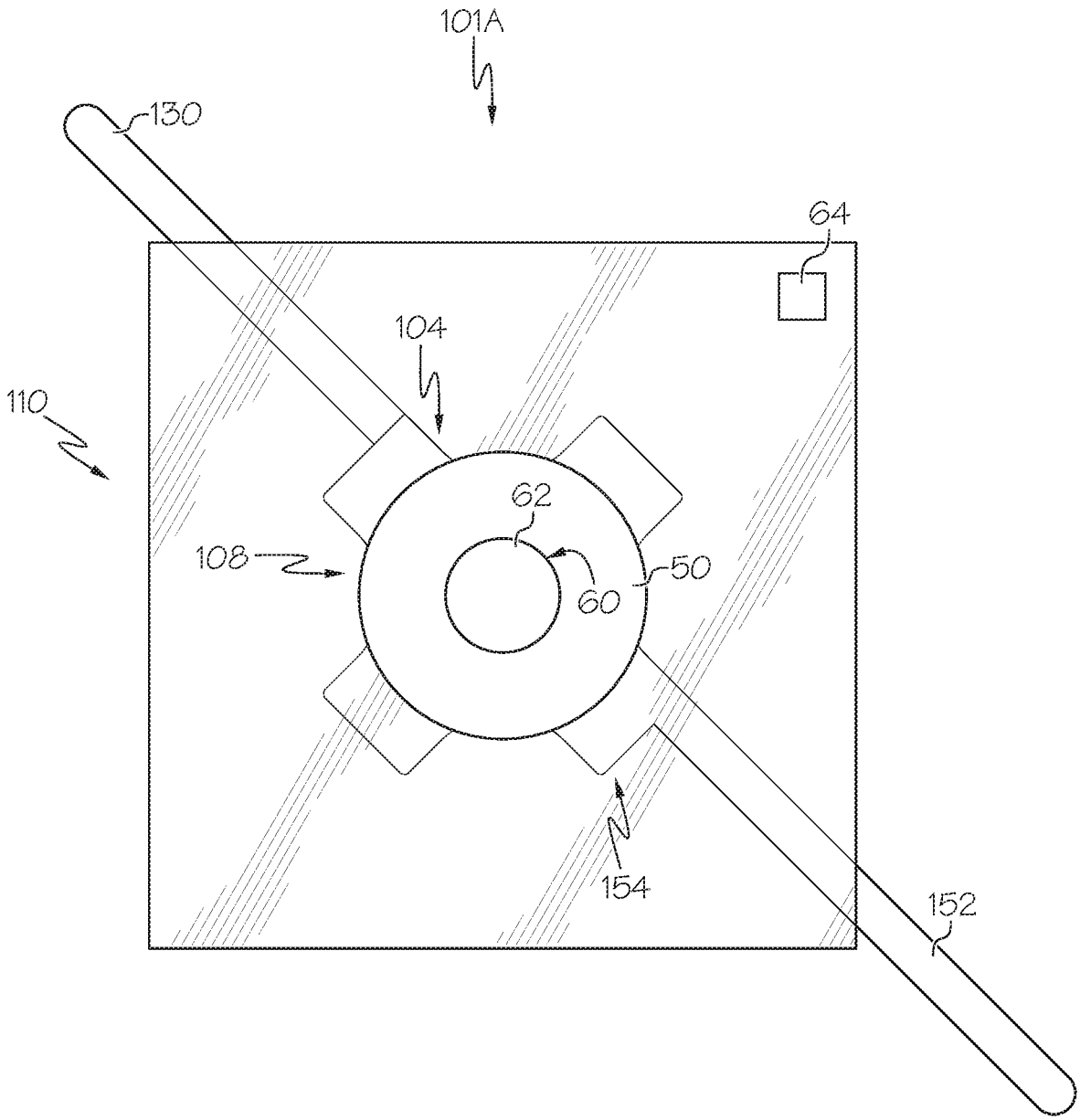
FIG. 5 schematically depict an illustrative artificial muscle of the support cushion liner of FIGS. 1-3, 4B, and 4C with a sensor and a temperature altering device coupled to the illustrative artificial muscle, according to one or more embodiments shown and described herein.

Referring now to FIGS. 3 and 5, in some embodiments the support cushion liner 10 comprises a plurality of sensors 60 and one or more temperature altering devices 70 disposed in the cavity 15 of the liner body 12. The plurality of sensors 60 may comprise one or more pressure sensors 62 (e.g., a plurality of pressure sensors 62) and/or one or more temperature sensors 64 (e.g., a plurality of temperature sensors 64). The first artificial muscle 101A of FIGS. 3 and 5 includes a pressure sensor 62 and a temperature sensor 64 each coupled to the housing 110 of the artificial muscles 101. In some embodiments an individual pressure sensor 62 may be coupled to the housing 110 of an individual artificial muscle 101 in alignment with the expandable fluid region 196 of the housing 110. Thus, the individual pressure sensor 62 can measure the pressure applied by the expandable fluid region 196 of the artificial muscle 101 to the outer layer 20 of the liner body 12 and thus applied to the user 5 when the artificial muscle 101 is actuated. Furthermore, the one or more pressure sensors 62 may measure the pressure applied by the outer layer 20 of the liner body 12 to the user 5 at one or more locations along the outer layer 20.

While FIGS. 3 and 5 illustrate sensors 60 coupled to a single artificial muscle 101A, it should be understood that sensors 60 may be coupled to any number of artificial muscles 101 of the plurality of artificial muscles 100, such as each artificial muscles 101 of the first layer of artificial muscles 102A or even each artificial muscle 101 of the plurality of artificial muscles 100. Moreover, in some embodiments, at least some of the plurality of sensors 60 may be disposed in the cavity 15 without being coupled to an individual artificial muscles 101. For example, in some embodiments, the pressure sensors 62 may be coupled to individual artificial muscles and the temperature sensors 64 may be coupled to the inner surfaces of 22, 32 of the outer and inner layers 20, 30.

In operation, each of the plurality of artificial muscles 100 are independently actuatable to apply selective pressure to the outer layer 20 of the liner body 12 in response to one or more pressure measurements by the plurality of pressure sensors 62. For example, the support cushion liner 10 may measure a pressure applied to one or more locations of the outer layer 20 using the one or more pressure sensors 62 and actuate the plurality of artificial muscles 100 in a selective manner to apply selective pressure to the outer layer 20 of the liner body 12 in response to pressure measurements by the one or more pressure sensors 62 at the one or more locations of the outer layer 20 of the liner body 12. In operation, actuation of the plurality of artificial muscles 101 may be adjusted by the actuation system 400 (e.g., a controller 50 of the of the actuation system 400) to occur either in direct response to offset sustained pressure points 6 or in rippling flows for a general massage effect. Indeed, the plurality of artificial muscles 100 may be actuated in a cascading, patterned, stochastic or uniform rhythm.

Referring still to FIGS. 3 and 5, the one or more temperature altering devices 70 disposed in the cavity 15 of the liner body 12 may be configured to heat or cool the outer layer 20 of the liner body 12. The first artificial muscle 101A of FIGS. 3 and 5 includes a temperature altering device 70 coupled to the housing 110 of the artificial muscles 101, for example between the expandable fluid region 196 and an individual pressure sensor 62. For example, individual temperature altering devices 70 may comprise a heat generating device, a cooling device, or a device that can selectively generate heating or cooling. Example heat generating devices includes integrated polyimide wrapped heater coils. Example cooling devices include thermoelectric cooler modules and ventilators, such as miniaturized ventilators and larger surface area ventilators such as those used in automotive seat ventilator packages. In some embodiments, the one or more temperature altering devices 70 are configured to heat or cool the cavity 15 of the liner body 12 in response to one or more temperature measurements by the one or more temperature sensors 64, which may comprise thermocouple feedback sensors. Heating the outer layer 20 of the liner body 12 may increase user comfort and may reduce user fatigue, for example, in embodiments in which the liner body 12 is coupled to a vehicle seat, airline seat, train seat, or other travel seat. Cooling the outer layer 20 of the liner body 12 may also increase user comfort.

While FIGS. 3 and 5 illustrate a temperature altering device 70 coupled to a single artificial muscle 101A, it should be understood that temperature altering devices 70 may be coupled to any number of artificial muscles 101 of the plurality of artificial muscles 100, such as each artificial muscles 101 of the first layer of artificial muscles 102A or even each artificial muscle 101 of the plurality of artificial muscles 100. Moreover, in some embodiments, at least some of the temperature altering devices 70 may be disposed in the cavity 15 without being coupled to an individual artificial muscles 101. For example, in some embodiments, temperature altering devices 70 may be coupled the inner surfaces of 22, 32 of the outer and inner layers 20, 30.

Figure 6:
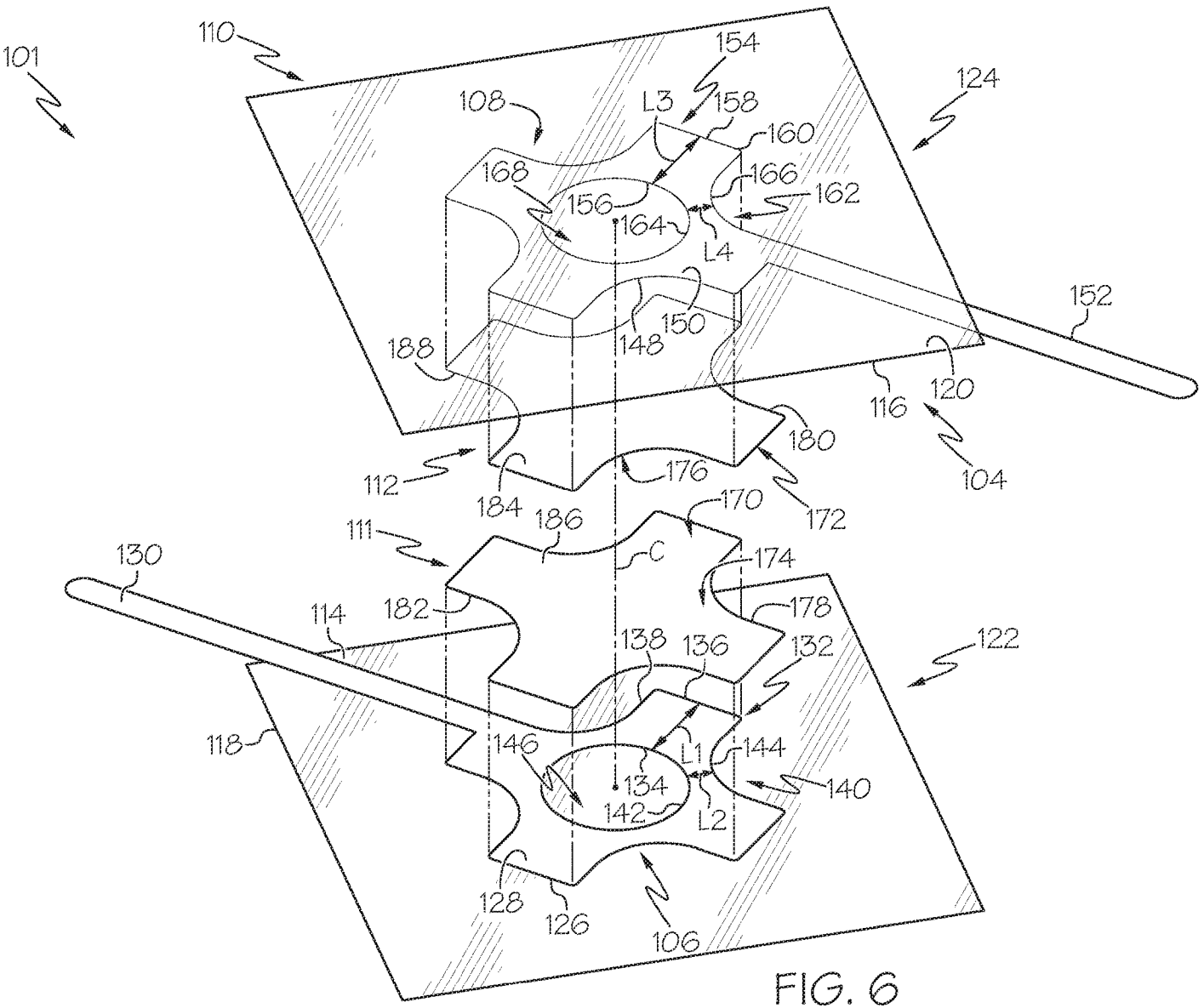
FIG. 6 schematically depicts an exploded view of an illustrative artificial muscle of the support cushion liner of FIGS. 1-3, 4B, and 4C, according to one or more embodiments shown and described herein.
Figure 7:
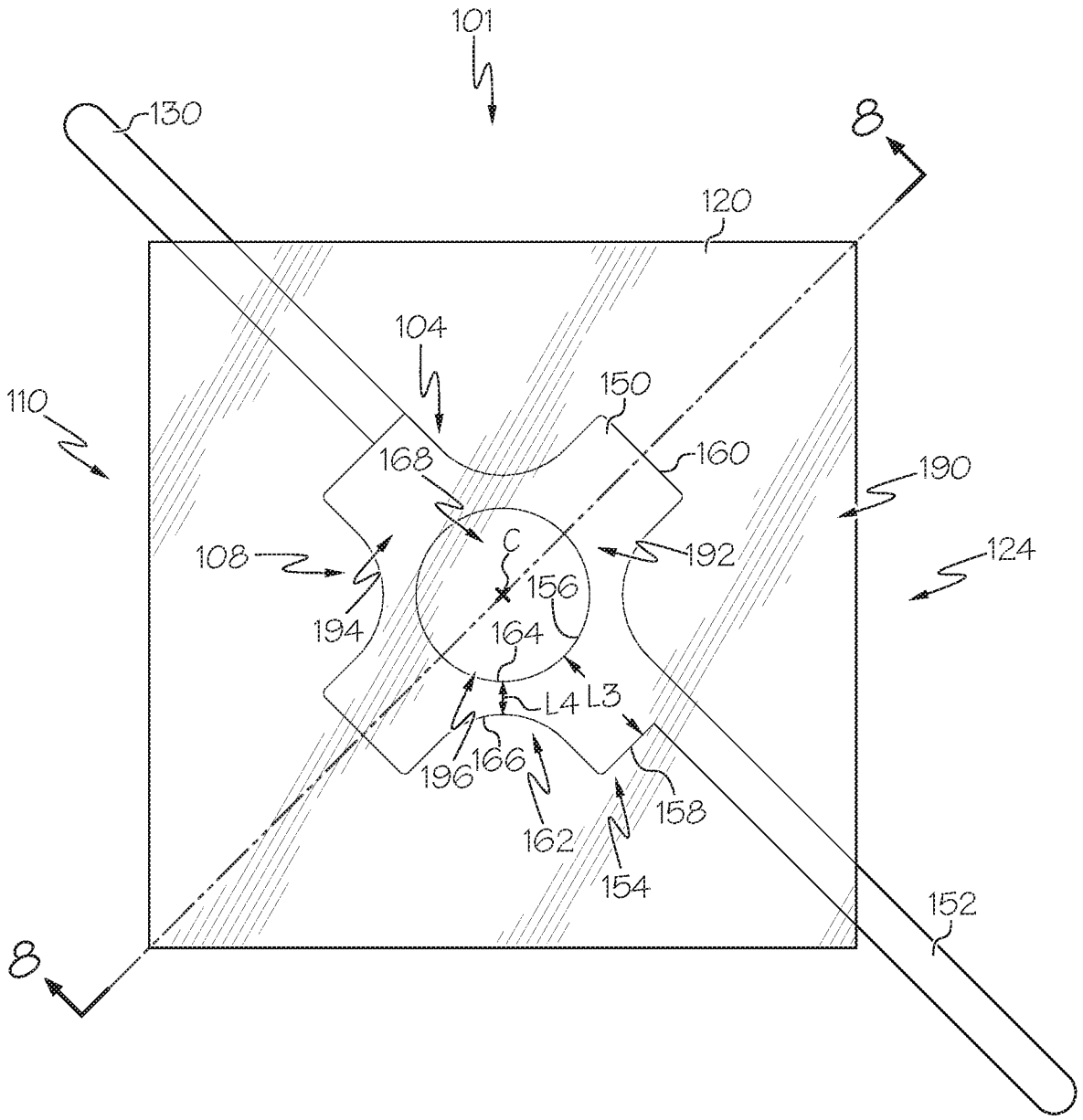
FIG. 7 schematically depicts a top view of the artificial muscle of FIG. 6, according to one or more embodiments shown and described herein.

Referring now to FIGS. 6 and 7, an example individual artificial muscle 101 of plurality of artificial muscles 100 of the support cushion liner 10 is depicted in more detail. The artificial muscle 101 includes the housing 110, the electrode pair 104, including a first electrode 106 and a second electrode 108, fixed to opposite surfaces of the housing 110, a first electrical insulator layer 111 fixed to the first electrode 106, and a second electrical insulator layer 112 fixed to the second electrode 108. In some embodiments, the housing 110 is a one-piece monolithic layer including a pair of opposite inner surfaces, such as a first inner surface 114 and a second inner surface 116, and a pair of opposite outer surfaces, such as a first outer surface 118 and a second outer surface 120. In some embodiments, the first inner surface 114 and the second inner surface 116 of the housing 110 are heat-sealable. In other embodiments, the housing 110 may be a pair of individually fabricated film layers, such as a first film layer 122 and a second film layer 124. Thus, the first film layer 122 includes the first inner surface 114 and the first outer surface 118, and the second film layer 124 includes the second inner surface 116 and the second outer surface 120.

While the embodiments described herein primarily refer to the housing 110 as comprising the first film layer 122 and the second film layer 124, as opposed to the one-piece housing, it should be understood that either arrangement is contemplated. In some embodiments, the first film layer 122 and the second film layer 124 generally include the same structure and composition. For example, in some embodiments, the first film layer 122 and the second film layer 124 each comprises biaxially oriented polypropylene.

The first electrode 106 and the second electrode 108 are each positioned between the first film layer 122 and the second film layer 124. In some embodiments, the first electrode 106 and the second electrode 108 are each aluminum-coated polyester such as, for example, Mylar®. In addition, one of the first electrode 106 and the second electrode 108 is a negatively charged electrode and the other of the first electrode 106 and the second electrode 108 is a positively charged electrode. For purposes discussed herein, either electrode 106, 108 may be positively charged so long as the other electrode 106, 108 of the artificial muscle 101 is negatively charged.

Figure 10:
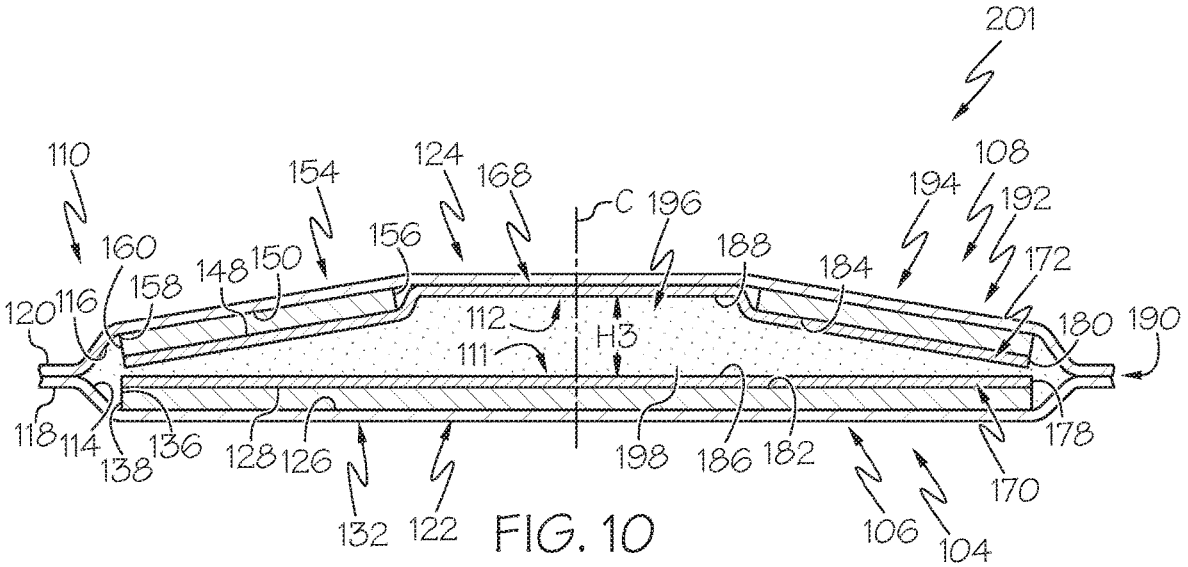
FIG. 10 schematically depicts a cross-sectional view of another illustrative artificial muscle in a non-actuated state, according to one or more embodiments shown and described herein.

The first electrode 106 has a film-facing surface 126 and an opposite inner surface 128. The first electrode 106 is positioned against the first film layer 122, specifically, the first inner surface 114 of the first film layer 122. In addition, the first electrode 106 includes a first terminal 130 extending from the first electrode 106 past an edge of the first film layer 122 such that the first terminal 130 can be connected to a power supply to actuate the first electrode 106. Specifically, the terminal is coupled, either directly or in series, to a power supply and a controller of an actuation system 400, as shown in FIG. 10. Similarly, the second electrode 108 has a film-facing surface 148 and an opposite inner surface 150. The second electrode 108 is positioned against the second film layer 124, specifically, the second inner surface 116 of the second film layer 124. The second electrode 108 includes a second terminal 152 extending from the second electrode 108 past an edge of the second film layer 124 such that the second terminal 152 can be connected to a power supply and a controller of the actuation system 400 to actuate the second electrode 108.

The first electrode 106 includes two or more tab portions 132 and two or more bridge portions 140. Each bridge portion 140 is positioned between adjacent tab portions 132, interconnecting these adjacent tab portions 132. Each tab portion 132 has a first end 134 extending radially from a center axis C of the first electrode 106 to an opposite second end 136 of the tab portion 132, where the second end 136 defines a portion of an outer perimeter 138 of the first electrode 106. Each bridge portion 140 has a first end 142 extending radially from the center axis C of the first electrode 106 to an opposite second end 144 of the bridge portion 140 defining another portion of the outer perimeter 138 of the first electrode 106. Each tab portion 132 has a tab length L1 and each bridge portion 140 has a bridge length L2 extending in a radial direction from the center axis C of the first electrode 106. The tab length L1 is a distance from the first end 134 to the second end 136 of the tab portion 132 and the bridge length L2 is a distance from the first end 142 to the second end 144 of the bridge portion 140. The tab length L1 of each tab portion 132 is longer than the bridge length L2 of each bridge portion 140. In some embodiments, the bridge length L2 is 20% to 50% of the tab length L1, such as 30% to 40% of the tab length L1.

In some embodiments, the two or more tab portions 132 are arranged in one or more pairs of tab portions 132. Each pair of tab portions 132 includes two tab portions 132 arranged diametrically opposed to one another. In some embodiments, the first electrode 106 may include only two tab portions 132 positioned on opposite sides or ends of the first electrode 106. In some embodiments, as shown in FIGS. 4 and 5, the first electrode 106 includes four tab portions 132 and four bridge portions 140 interconnecting adjacent tab portions 132. In this embodiment, the four tab portion 132 are arranged as two pairs of tab portions 132 diametrically opposed to one another. Furthermore, as shown, the first terminal 130 extends from the second end 136 of one of the tab portions 132 and is integrally formed therewith.

Like the first electrode 106, the second electrode 108 includes at least a pair of tab portions 154 and two or more bridge portions 162. Each bridge portion 162 is positioned between adjacent tab portions 154, interconnecting these adjacent tab portions 154. Each tab portion 154 has a first end 156 extending radially from a center axis C of the second electrode 108 to an opposite second end 158 of the tab portion 154, where the second end 158 defines a portion of an outer perimeter 160 of the second electrode 108. Due to the first electrode 106 and the second electrode 108 being coaxial with one another, the center axis C of the first electrode 106 and the second electrode 108 are the same. Each bridge portion 162 has a first end 164 extending radially from the center axis C of the second electrode to an opposite second end 166 of the bridge portion 162 defining another portion of the outer perimeter 160 of the second electrode 108. Each tab portion 154 has a tab length L3 and each bridge portion 162 has a bridge length L4 extending in a radial direction from the center axis C of the second electrode 108. The tab length L3 is a distance from the first end 156 to the second end 158 of the tab portion 154 and the bridge length L4 is a distance from the first end 164 to the second end 166 of the bridge portion 162. The tab length L3 is longer than the bridge length L4 of each bridge portion 162. In some embodiments, the bridge length L4 is 20% to 50% of the tab length L3, such as 30% to 40% of the tab length L3.

In some embodiments, the two or more tab portions 154 are arranged in one or more pairs of tab portions 154. Each pair of tab portions 154 includes two tab portions 154 arranged diametrically opposed to one another. In some embodiments, the second electrode 108 may include only two tab portions 154 positioned on opposite sides or ends of the first electrode 106. In some embodiments, as shown in FIGS. 6 and 7, the second electrode 108 includes four tab portions 154 and four bridge portions 162 interconnecting adjacent tab portions 154. In this embodiment, the four tab portions 154 are arranged as two pairs of tab portions 154 diametrically opposed to one another. Furthermore, as shown, the second terminal 152 extends from the second end 158 of one of the tab portions 154 and is integrally formed therewith.

Figure 8:
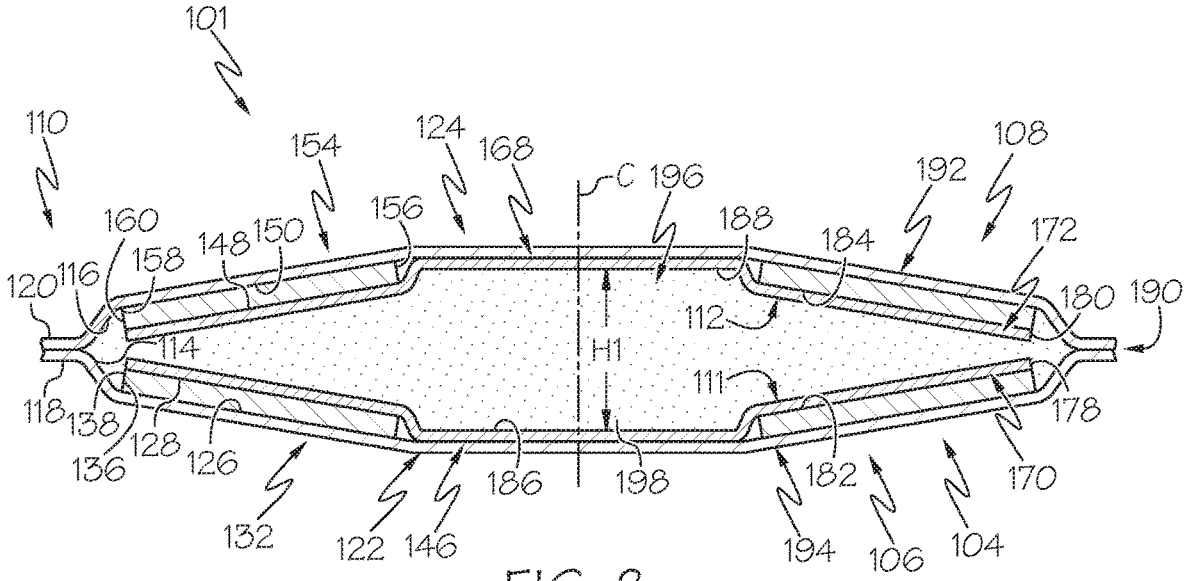
FIG. 8 schematically depicts a cross-sectional view of the artificial muscle of FIG. 7 taken along line 8-8 in FIG. 7 in a non-actuated state, according to one or more embodiments shown and described herein.
Figure 9:
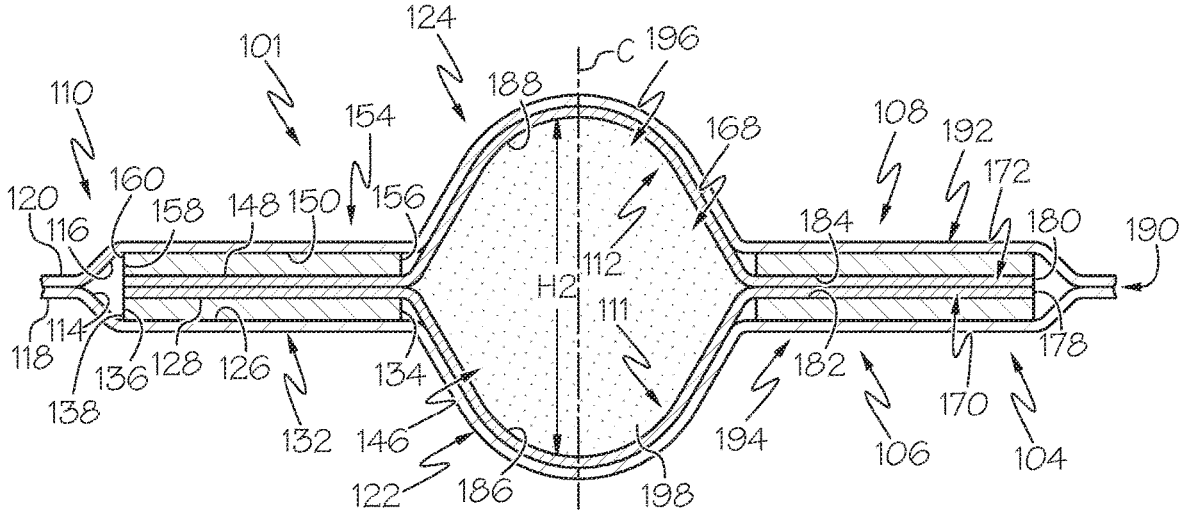
FIG. 9 schematically depicts a cross-sectional view of the artificial muscle of FIG. 7 taken along line 8-8 in FIG. 7 in an actuated state, according to one or more embodiments shown and described herein.
Figure 11:
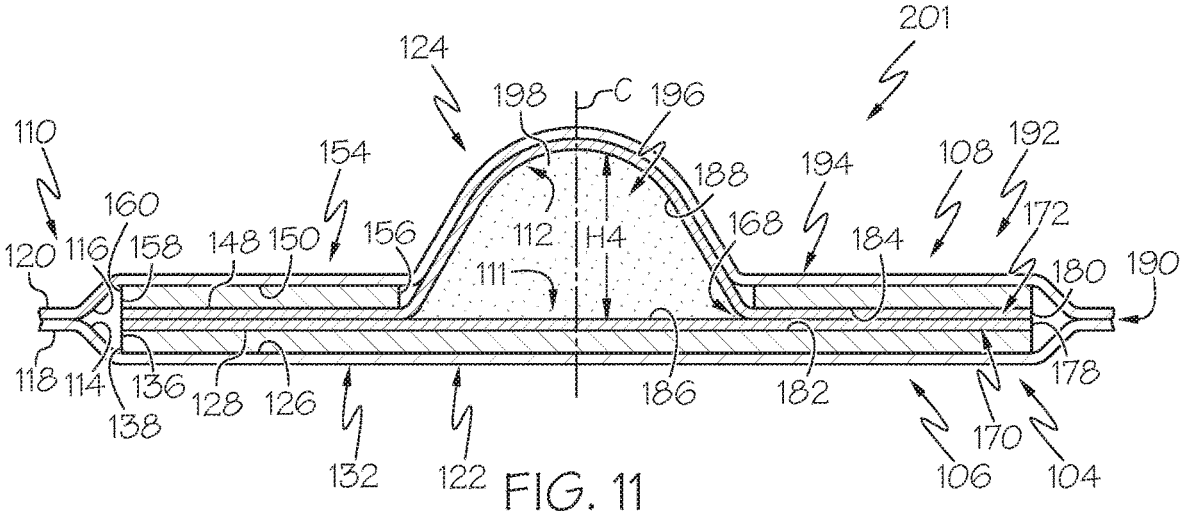
FIG. 11 schematically depicts a cross-sectional view of the artificial muscle of FIG. 10 in an actuated state, according to one or more embodiments shown and described herein.

Referring now to FIGS. 6-11, at least one of the first electrode 106 and the second electrode 108 has a central opening formed therein between the first end 134 of the tab portions 132 and the first end 142 of the bridge portions 140. In FIGS. 8 and 9, the first electrode 106 has a central opening 146. However, it should be understood that the first electrode 106 does not need to include the central opening 146 when a central opening is provided within the second electrode 108, as shown in FIGS. 10 and 11. Alternatively, the second electrode 108 does not need to include the central opening when the central opening 146 is provided within the first electrode 106. Referring still to FIGS. 6-11, the first electrical insulator layer 111 and the second electrical insulator layer 112 have a geometry generally corresponding to the first electrode 106 and the second electrode 108, respectively. Thus, the first electrical insulator layer 111 and the second electrical insulator layer 112 each have tab portions 170, 172 and bridge portions 174, 176 corresponding to like portions on the first electrode 106 and the second electrode 108. Further, the first electrical insulator layer 111 and the second electrical insulator layer 112 each have an outer perimeter 178, 180 corresponding to the outer perimeter 138 of the first electrode 106 and the outer perimeter 160 of the second electrode 108, respectively, when positioned thereon.

It should be appreciated that, in some embodiments, the first electrical insulator layer 111 and the second electrical insulator layer 112 generally include the same structure and composition. As such, in some embodiments, the first electrical insulator layer 111 and the second electrical insulator layer 112 each include an adhesive surface 182, 184 and an opposite non-sealable surface 186, 188, respectively. Thus, in some embodiments, the first electrical insulator layer 111 and the second electrical insulator layer 112 are each a polymer tape adhered to the inner surface 128 of the first electrode 106 and the inner surface 150 of the second electrode 108, respectively.

Referring now to FIGS. 7-11, the artificial muscle 101 is shown in its assembled form with the first terminal 130 of the first electrode 106 and the second terminal 152 of the second electrode 108 extending past an outer perimeter of the housing 110, i.e., the first film layer 122 and the second film layer 124. As shown in FIG. 5, the second electrode 108 is stacked on top of the first electrode 106 and, therefore, the first electrode 106, the first film layer 122, and the second film layer 124 are not shown. In its assembled form, the first electrode 106, the second electrode 108, the first electrical insulator layer 111, and the second electrical insulator layer 112 are sandwiched between the first film layer 122 and the second film layer 124. The first film layer 122 is partially sealed to the second film layer 124 at an area surrounding the outer perimeter 138 of the first electrode 106 and the outer perimeter 160 of the second electrode 108. In some embodiments, the first film layer 122 is heat-sealed to the second film layer 124. Specifically, in some embodiments, the first film layer 122 is sealed to the second film layer 124 to define a sealed portion 190 surrounding the first electrode 106 and the second electrode 108. The first film layer 122 and the second film layer 124 may be sealed in any suitable manner, such as using an adhesive, heat sealing, or the like.

The first electrode 106, the second electrode 108, the first electrical insulator layer 111, and the second electrical insulator layer 112 provide a barrier that prevents the first film layer 122 from sealing to the second film layer 124 forming an unsealed portion 192. The unsealed portion 192 of the housing 110 includes the electrode region 194, in which the electrode pair 104 is provided, and the expandable fluid region 196, which is surrounded by the electrode region 194. The central openings 146, 168 of the first electrode 106 and the second electrode 108 form the expandable fluid region 196 and are arranged to be axially stacked on one another. Although not shown, the housing 110 may be cut to conform to the geometry of the electrode pair 104 and reduce the size of the artificial muscle 101, namely, the size of the sealed portion 190.

A dielectric fluid 198 is provided within the unsealed portion 192 and flows freely between the first electrode 106 and the second electrode 108. A "dielectric" fluid as used herein is a medium or material that transmits electrical force without conduction and as such has low electrical conductivity. Some non-limiting example dielectric fluids include perfluoroalkanes, transformer oils, and deionized water. It should be appreciated that the dielectric fluid 198 may be injected into the unsealed portion 192 of the artificial muscle 101 using a needle or other suitable injection device.

Referring now to FIGS. 8 and 9, the artificial muscle 101 is actuatable between a non-actuated state and an actuated state. In the non-actuated state, as shown in FIG. 8, the first electrode 106 and the second electrode 108 are partially spaced apart from one another proximate the central openings 146, 168 thereof and the first end 134, 156 of the tab portions 132, 154. The second end 136, 158 of the tab portions 132, 154 remain in position relative to one another due to the housing 110 being sealed at the outer perimeter 138 of the first electrode 106 and the outer perimeter 160 of the second electrode 108. In FIGS. 4B and 4C, at least one of the one or more artificial muscles 101 of the support cushion liner 10 is in the non-actuated state. In the actuated state, as shown in FIG. 9, the first electrode 106 and the second electrode 108 are brought into contact with and oriented parallel to one another to force the dielectric fluid 198 into the expandable fluid region 196. This causes the dielectric fluid 198 to flow through the central openings 146, 168 of the first electrode 106 and the second electrode 108 and inflate the expandable fluid region 196. In FIG. 4C, at least one of the one or more artificial muscles 101 of the support cushion liner 10 is in the actuated state.

Referring now to FIG. 8, the artificial muscle 101 is shown in the non-actuated state. The electrode pair 104 is provided within the electrode region 194 of the unsealed portion 192 of the housing 110. The central opening 146 of the first electrode 106 and the central opening 168 of the second electrode 108 are coaxially aligned within the expandable fluid region 196. In the non-actuated state, the first electrode 106 and the second electrode 108 are partially spaced apart from and non-parallel to one another. Due to the first film layer 122 being sealed to the second film layer 124 around the electrode pair 104, the second end 136, 158 of the tab portions 132, 154 are brought into contact with one another. Thus, dielectric fluid 198 is provided between the first electrode 106 and the second electrode 108, thereby separating the first end 134, 156 of the tab portions 132, 154 proximate the expandable fluid region 196. Stated another way, a distance between the first end 134 of the tab portion 132 of the first electrode 106 and the first end 156 of the tab portion 154 of the second electrode 108 is greater than a distance between the second end 136 of the tab portion 132 of the first electrode 106 and the second end 158 of the tab portion 154 of the second electrode 108. This results in the electrode pair 104 zippering toward the expandable fluid region 196 when actuated. In some embodiments, the first electrode 106 and the second electrode 108 may be flexible. Thus, as shown in FIG. 6, the first electrode 106 and the second electrode 108 are convex such that the second ends 136, 158 of the tab portions 132, 154 thereof may remain close to one another, but spaced apart from one another proximate the central openings 146, 168. In the non-actuated state, the expandable fluid region 196 has a first height H1.

When actuated, as shown in FIG. 9, the first electrode 106 and the second electrode 108 zipper toward one another from the second ends 144, 158 of the tab portions 132, 154 thereof, thereby pushing the dielectric fluid 198 into the expandable fluid region 196. As shown, when in the actuated state, the first electrode 106 and the second electrode 108 are parallel to one another. In the actuated state, the dielectric fluid 198 flows into the expandable fluid region 196 to inflate the expandable fluid region 196. As such, the first film layer 122 and the second film layer 124 expand in opposite directions. In the actuated state, the expandable fluid region 196 has a second height H2, which is greater than the first height H1 of the expandable fluid region 196 when in the non-actuated state. Although not shown, it should be noted that the electrode pair 104 may be partially actuated to a position between the non-actuated state and the actuated state. This would allow for partial inflation of the expandable fluid region 196 and adjustments when necessary.

Figure 12:
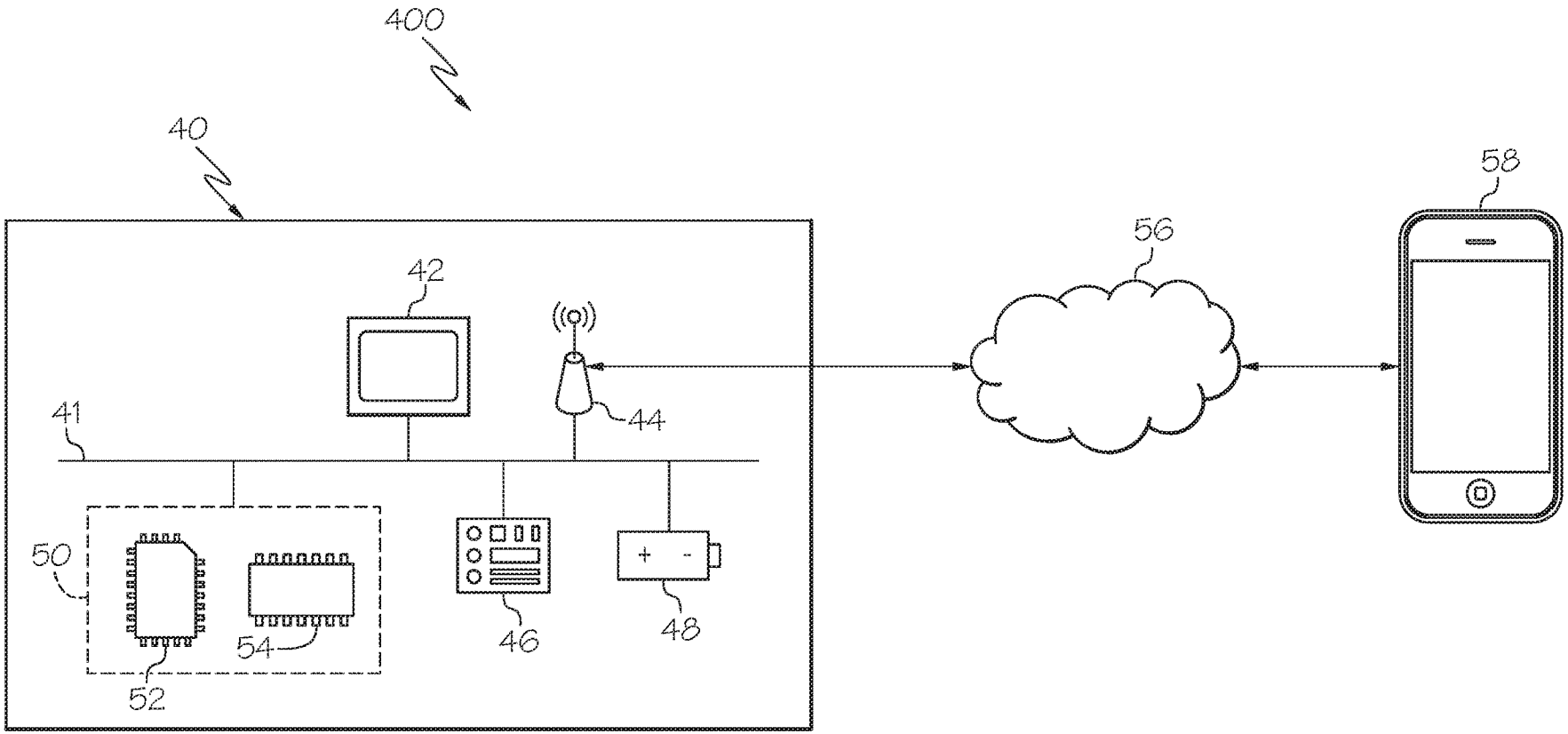
FIG. 12 schematically depicts an actuation system for operating the support cushion liner of FIGS. 1-3, 4B, and 4C, according to one or more embodiments shown and described herein.

In order to move the first electrode 106 and the second electrode 108 toward one another, a voltage is applied by a power supply (such as power supply 48 of FIG. 12). In some embodiments, a voltage of up to 10 kV may be provided from the power supply to induce an electric field through the dielectric fluid 198. The resulting attraction between the first electrode 106 and the second electrode 108 pushes the dielectric fluid 198 into the expandable fluid region 196. Pressure from the dielectric fluid 198 within the expandable fluid region 196 causes the first film layer 122 and the first electrical insulator layer 111 to deform in a first axial direction along the center axis C of the first electrode 106 and causes the second film layer 124 and the second electrical insulator layer 112 to deform in an opposite second axial direction along the center axis C of the second electrode 108. Once the voltage being supplied to the first electrode 106 and the second electrode 108 is discontinued, the first electrode 106 and the second electrode 108 return to their initial, non-parallel position in the non-actuated state.

It should be appreciated that the present embodiments of the artificial muscle 101 disclosed herein, specifically, the tab portions 132, 154 with the interconnecting bridge portions 174, 176, provide a number of improvements over actuators that do not include the tab portions 132, 154, such as hydraulically amplified self-healing electrostatic (HASEL) actuators described in the paper titled "*Hydraulically amplified self-healing electrostatic actuators with muscle-like performance*" by E. Acome, S. K. Mitchell, T. G. Morrissey, M. B. Emmett, C. Benjamin, M. King, M. Radakovitz, and C. Keplinger (Science 5 Jan. 2018: Vol. 359, Issue 6371, pp. 61-65). Embodiments of the artificial muscle 101 including two pairs of tab portions 132, 154 on each of the first electrode 106 and the second electrode 108, respectively, reduces the overall mass and thickness of the artificial muscle 101, reduces the amount of voltage required during actuation, and decreases the total volume of the artificial muscle 101 without reducing the amount of resulting force after actuation as compared to known HASEL actuators including donut-shaped electrodes having a uniform, radially-extending width. More particularly, the tab portions 132, 154 of the artificial muscle 101 provide zipping fronts that result in increased actuation power by providing localized and uniform hydraulic actuation of the artificial muscle 101 compared to HASEL actuators including donut-shaped electrodes. Specifically, one pair of tab portions 132, 154 provides twice the amount of actuator power per unit volume as compared to donut-shaped HASEL actuators, while two pairs of tab portions 132, 154 provide four times the amount of actuator power per unit volume. The bridge portions 174, 176 interconnecting the tab portions 132, 154 also limit buckling of the tab portions 132, 154 by maintaining the distance between adjacent tab portions 132, 154 during actuation. Because the bridge portions 174, 176 are integrally formed with the tab portions 132, 154, the bridge portions 174, 176 also prevent leakage between the tab portions 132, 154 by eliminating attachment locations that provide an increased risk of rupturing.

In operation, when the artificial muscle 101 is actuated, expansion of the expandable fluid region 196 produces a force of 3 Newton-millimeters (N·mm) per cubic centimeter ($cm^3$) of actuator volume or greater, such as 4 N·mm per $cm^3$ or greater, 5 N·mm per $cm^3$ or greater, 6 N·mm per $cm^3$ or greater, 7 N·mm per $cm^3$ or greater, 8 N·mm per $cm^3$ or greater, or the like. In one example, when the artificial muscle 101 is actuated by a voltage of 9.5 kilovolts (kV), the artificial muscle 101 provides a resulting force of 5 N. In another example, when the artificial muscle 101 is actuated by a voltage of 10 kV the artificial muscle 101 provides 440% strain under a 500 gram load.

Moreover, the size of the first electrode 106 and the second electrode 108 is proportional to the amount of displacement of the dielectric fluid 198. Therefore, when greater displacement within the expandable fluid region 196 is desired, the size of the electrode pair 104 is increased relative to the size of the expandable fluid region 196. It should be appreciated that the size of the expandable fluid region 196 is defined by the central openings 146, 168 in the first electrode 106 and the second electrode 108. Thus, the degree of displacement within the expandable fluid region 196 may alternatively, or in addition, be controlled by increasing or reducing the size of the central openings 146, 168.

As shown in FIGS. 10 and 11, another embodiment of an artificial muscle 201 is illustrated. The artificial muscle 201 is substantially similar to the artificial muscle 101. As such, like structure is indicated with like reference numerals. However, as shown, the first electrode 106 does not include a central opening. Thus, only the second electrode 108 includes the central opening 168 formed therein. As shown in FIG. 10, the artificial muscle 201 is in the non-actuated state with the first electrode 106 being planar and the second electrode 108 being convex relative to the first electrode 106. In the non-actuated state, the expandable fluid region 196 has a first height H3. In the actuated state, as shown in FIG. 11, the expandable fluid region 196 has a second height H4, which is greater than the first height H3. It should be appreciated that by providing the central opening 168 only in the second electrode 108 as opposed to both the first electrode 106 and the second electrode 108, the total deformation may be formed on one side of the artificial muscle 201. In addition, because the total deformation is formed on only one side of the artificial muscle 201, the second height H4 of the expandable fluid region 196 of the artificial muscle 201 extends further from a longitudinal axis perpendicular to the central axis C of the artificial muscle 201 than the second height H2 of the expandable fluid region 196 of the artificial muscle 101 when all other dimensions, orientations, and volume of dielectric fluid are the same. It should be understood that embodiments of the artificial muscle 201 may be used together with or in place of the one or more artificial muscles 101 of the support cushion liner 10 of FIGS. 1-3, 4B, and 4C.

Referring now to FIG. 12, an actuation system 400 may be provided for operating the support cushion liner 10, in particular, for operating the plurality of artificial muscles 100 and the one or more temperature altering devices 70 of the support cushion liner 10, for example, based on sensor measurements of the one or more sensors 60, instructions provided by a user, or a combination thereof. The actuation system 400 may comprise a controller 50, an operating device 46, a power supply 48, a display device 42, network interface hardware 44, and a communication path 41 communicatively coupled these components, some or all of which may be disposed in the onboard control unit 40. Furthermore, the actuation system 400 may be communicatively coupled to the plurality of artificial muscles 100, the one or more temperature altering devices 70, and the one or more sensors 60.

The controller 50 comprises a processor 52 and a non-transitory electronic memory 54 to which various components are communicatively coupled. In some embodiments, the processor 52 and the non-transitory electronic memory 54 and/or the other components are included within a single device. In other embodiments, the processor 52 and the non-transitory electronic memory 54 and/or the other components may be distributed among multiple devices that are communicatively coupled. The controller 50 includes non-transitory electronic memory 54 that stores a set of machine-readable instructions. The processor 52 executes the machine-readable instructions stored in the non-transitory electronic memory 54. The non-transitory electronic memory 54 may comprise RAM, ROM, flash memories, hard drives, or any device capable of storing machine-readable instructions such that the machine-readable instructions can be accessed by the processor 52. Accordingly, the actuation system 400 described herein may be implemented in any conventional computer programming language, as pre-programmed hardware elements, or as a combination of hardware and software components. The non-transitory electronic memory 54 may be implemented as one memory module or a plurality of memory modules.

In some embodiments, the non-transitory electronic memory 54 includes instructions for executing the functions of the actuation system 400. The instructions may include instructions for operating the support cushion liner 10, for example, instructions for actuating the plurality of artificial muscles 100, individually or collectively, and instructions for operating the temperature altering devices 70, individually or collectively.

The processor 52 may be any device capable of executing machine-readable instructions. For example, the processor 52 may be an integrated circuit, a microchip, a computer, or any other computing device. The non-transitory electronic memory 54 and the processor 52 are coupled to the communication path 41 that provides signal interconnectivity between various components and/or modules of the actuation system 400. Accordingly, the communication path 41 may communicatively couple any number of processors with one another, and allow the modules coupled to the communication path 41 to operate in a distributed computing environment. Specifically, each of the modules may operate as a node that may send and/or receive data. As used herein, the term "communicatively coupled" means that coupled components are capable of exchanging data signals with one another such as, for example, electrical signals via conductive medium, electromagnetic signals via air, optical signals via optical waveguides, and the like.

As schematically depicted in FIG. 12, the communication path 41 communicatively couples the processor 52 and the non-transitory electronic memory 54 of the controller 50 with a plurality of other components of the actuation system 400. For example, the actuation system 400 depicted in FIG. 12 includes the processor 52 and the non-transitory electronic memory 54 communicatively coupled with the operating device 46 and the power supply 48.

The operating device 46 allows for a user to control operation of the plurality of artificial muscles 100 and the one or more temperature altering devices 70 of the support cushion liner 10. In some embodiments, the operating device 46 may be a switch, toggle, button, or any combination of controls to provide user operation. The operating device 46 is coupled to the communication path 41 such that the communication path 41 communicatively couples the operating device 46 to other modules of the actuation system 400. The operating device 46 may provide a user interface for receiving user instructions as to a specific operating configuration of the support cushion liner 10, such as an operating configuration to continuously or sporadically alter the pressure points 6 between the outer layer 20 and the user 5 by selective actuation of the plurality of artificial muscles 100. Other operating configurations of the support cushion liner 10 include actuating the plurality of artificial muscles 100 in a cascading, patterned, stochastic or uniform rhythm and provide selective or uniform heating and/or cooling using the one or more temperature altering device 70.

The power supply 48 (e.g., battery) provides power to the one or more artificial muscles 101 of the support cushion liner 10. In some embodiments, the power supply 48 is a rechargeable direct current power source. It is to be understood that the power supply 48 may be a single power supply or battery for providing power to the one or more artificial muscles 101 of the support cushion liner 10. A power adapter (not shown) may be provided and electrically coupled via a wiring harness or the like for providing power to the plurality of artificial muscles 100 of the support cushion liner 10 via the power supply 48.

In some embodiments, the actuation system 400 also includes a display device 42. The display device 42 is coupled to the communication path 41 such that the communication path 41 communicatively couples the display device 42 to other modules of the actuation system 400. The display device 42 may be located on the liner body 12, for example, as part of the onboard control unit 40, and may output a notification in response to an actuation state of the artificial muscles 101 of the support cushion liner 10 or indication of a change in the actuation state of the one or more artificial muscles 101 of the support cushion liner 10. The display device 42 may also display sensor measurements, such as pressure and temperature measurements performed by the one or more pressure sensors 62 and the one or more temperature sensors 64, respectively. Moreover, the display device 42 may be a touchscreen that, in addition to providing optical information, detects the presence and location of a tactile input upon a surface of or adjacent to the display device 42. Accordingly, the display device 42 may include the operating device 46 and receive mechanical input directly upon the optical output provided by the display device 42.

In some embodiments, the actuation system 400 includes network interface hardware 44 for communicatively coupling the actuation system 400 to a portable device 58 via a network 56. The portable device 58 may include, without limitation, a smartphone, a tablet, a personal media player, or any other electric device that includes wireless communication functionality. It is to be appreciated that, when provided, the portable device 58 may serve to provide user commands to the controller 50, instead of the operating device 46. As such, a user may be able to control or set a program for controlling the artificial muscles 101 and the one or more temperature altering devices 70 of the support cushion liner 10 utilizing the controls of the operating device 46. Thus, the artificial muscles 100 of the support cushion liner 10 may be controlled remotely via the portable device 58 wirelessly communicating with the controller 50 via the network 56.

It should now be understood that embodiments described herein are directed to support cushion liners that include a plurality of artificial muscles disposed in a cavity of a liner body between an inner layer and an outer layer of the liner body. The artificial muscles are actuatable to selectively apply pressure to the outer layer to apply a selective and customizable pressure to a user sitting or lying on the outer layer of the liner body. The selective and customizable actuation of the plurality of artificial muscles may adjust the pressure distribution applied to a user, such as a user with limited mobility (e.g. bedridden or wheelchair bound).

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A support cushion liner comprising:

a liner body comprising a cavity disposed between an outer layer and an inner layer; and a plurality of artificial muscles disposed in the cavity of the liner body, wherein each of the plurality of artificial muscles comprise:

a housing comprising an electrode region and an expandable fluid region;

a dielectric liquid housed within the housing; and an electrode pair positioned in the electrode region of the housing, the electrode pair comprising a first electrode fixed to a first surface of the housing and a second electrode fixed to a second surface of the housing, wherein the electrode pair is actuatable between a non-actuated state and an actuated state such that actuation from the non-actuated state to the actuated state directs the dielectric liquid into the expandable fluid region, expanding the expandable fluid region thereby applying pressure to the outer layer of the liner body, and wherein at least one of the first electrode and the second electrode comprises a central opening encircling the expandable fluid region.

2. The support cushion liner of claim 1, wherein the outer layer comprises a nonabsorbent material.

3. The support cushion liner of claim 1, wherein the plurality of artificial muscles are arranged in a single layer between the inner layer and the outer layer.

4. The support cushion liner of claim 1, wherein the plurality of artificial muscles are arranged in a two or more layers between the inner layer and the outer layer.

5. The support cushion liner of claim 1, wherein:

the first electrode and the second electrode each comprise two or more tab portions and two or more bridge portions;

each of the two or more bridge portions interconnects adjacent tab portions; and the central opening is positioned between the two or more tab portions of the at least one of the first electrode and the second electrode.

6. The support cushion liner of claim 5, wherein the first electrode and the second electrode each includes two pairs of tab portions and two pairs of bridge portions, each bridge portion interconnecting adjacent a pair of adjacent tab portions, each tab portion diametrically opposing an opposite tab portion.

7. The support cushion liner of claim 5, wherein:

when the electrode pair is in the non-actuated state, the first electrode and the second electrode are non-parallel to one another; and when the electrode pair is in the actuated state, the first electrode and the second electrode are parallel to one another, such that the first electrode and the second electrode are configured to zipper toward one another and toward the central opening when actuated from the non-actuated state to the actuated state.

8. The support cushion liner of claim 1, wherein the housing of each of the plurality of artificial muscles comprises a first film layer and a second film layer partially sealed to one another to define a sealed portion of the housing, the housing further comprising an unsealed portion surrounded by the sealed portion, wherein the electrode region and the expandable fluid region of the housing are disposed in the unsealed portion.

9. The support cushion liner of claim 1, further comprising a first electrical insulator layer fixed to an inner surface of the first electrode opposite the first surface of the housing and a second electrical insulator layer fixed to an inner surface of the second electrode opposite the second surface of the housing, wherein the first electrical insulator layer and the second electrical insulator layer each includes an adhesive surface and an opposite non-sealable surface.

10. The support cushion liner of claim 1, further comprising one or more pressure sensors disposed in the cavity of the liner body.

11. The support cushion liner of claim 1, further comprising one or more temperature sensors disposed in the cavity of the liner body.

12. The support cushion liner of claim 1, further comprising one or more temperature altering devices disposed in the cavity of the liner body and configured to heat or cool the outer layer of the liner body.

13. A support cushion liner comprising:

a liner body comprising a cavity disposed between an outer layer and an inner layer;

a plurality of pressure sensors disposed in the cavity of the liner body; and a plurality of artificial muscles disposed in the cavity of the liner body, wherein each artificial muscle of the plurality of artificial muscles comprise:

a housing comprising an electrode region and an expandable fluid region;

a dielectric liquid housed within the housing; and an electrode pair positioned in the electrode region of the housing, the electrode pair comprising a first electrode fixed to a first surface of the housing and a second electrode fixed to a second surface of the housing, wherein the electrode pair is actuatable between a non-actuated state and an actuated state such that actuation from the non-actuated state to the actuated state directs the dielectric liquid into the expandable fluid region, wherein each of the plurality of artificial muscles are independently actuatable to apply selective pressure to the outer layer of the liner body in response to one or more pressure measurements by the plurality of pressure sensors, and wherein at least one of the first electrode and the second electrode comprises a central opening encircling the expandable fluid region.

14. The support cushion liner of claim 13, wherein:

the first electrode and the second electrode each comprise two or more tab portions and two or more bridge portions;

each of the two or more bridge portions interconnects adjacent tab portions; and the central opening is positioned between the two or more tab portions of the at least one of the first electrode and the second electrode.

15. The support cushion liner of claim 13, wherein:

the plurality of pressure sensors are each coupled to the housing of an individual artificial muscle of the plurality of artificial muscles; and each of the plurality of pressure sensors are coupled to the housing of an individual artificial muscle of the plurality of artificial muscles in alignment with the expandable fluid region of the housing.

16. The support cushion liner of claim 13, further comprising one or more temperature sensors disposed in the cavity of the liner body and one or more temperature altering devices disposed in the cavity of the liner body, wherein the one or more temperature altering devices are configured to heat or cool the cavity of the liner body in response to one or more temperature measurements by the one or more temperature sensors.

17. A method for actuating a support cushion liner, the method comprising:

generating a voltage using a power supply electrically coupled to an electrode pair of an artificial muscle, the artificial muscle disposed in a cavity between an inner layer and an outer layer of a liner body, wherein:

the artificial muscle comprises a housing having an electrode region and an expandable fluid region;

the electrode pair is positioned in the electrode region of the housing;

the electrode pair comprises a first electrode fixed to a first surface of the housing and a second electrode fixed to a second surface of the housing; and a dielectric liquid is housed within the housing; and applying the voltage to the electrode pair of the artificial muscle, thereby actuating the electrode pair from a non-actuated state to an actuated state such that the dielectric liquid is directed into the expandable fluid region of the housing and expands the expandable fluid region, thereby applying pressure to the outer layer of the liner body, wherein at least one of the first electrode and the second electrode comprises a central opening encircling the expandable fluid region.

18. The method of claim 17, wherein the artificial muscle is one of a plurality of artificial muscles disposed in the cavity of the liner body.

19. The method of claim 18, further comprising:

measuring a pressure applied to the outer layer of the liner body using one or more pressure sensors disposed in the cavity of the liner body and applying voltage to the plurality of artificial muscles in a selective manner to apply selective pressure to the outer layer of the liner body in response to pressure measurements at the outer layer of the liner body.

20. The method of claim 17, further comprising directing the dielectric liquid into the expandable fluid region by converging the electrode pair.

* * * * *